US005251787A

United States Patent [19]

Simson

[11] Patent Number: 5,251,787

[45] Date of Patent: Oct. 12, 1993

[54] PRESSURIZED CONTAINER DISPENSER

[76] Inventor: Anton K. Simson, 13227 Aubrey, Poway, Calif. 92064

[21] Appl. No.: 848,323

[22] Filed: Mar. 9, 1992

[51] Int. Cl.[5] ..... B65D 35/28

[52] U.S. Cl. ..... 222/95; 222/105; 222/394; 222/386.5; 222/389

[58] Field of Search ..... 222/394, 396, 397, 399, 222/401, 386.5, 183, 105, 95, 389

[56] References Cited

U.S. PATENT DOCUMENTS

| | | | |
|---|---|---|---|
| 4,147,278 | 4/1979 | Uhlig | 222/95 X |
| 4,265,374 | 5/1981 | Sebalos | 222/95 |
| 4,438,856 | 3/1984 | Chang | 215/1 CX |
| 4,702,396 | 10/1987 | Gwiazda | 222/399 X |
| 4,708,938 | 11/1987 | Hickinbotham | 222/95 X |
| 4,921,135 | 5/1990 | Pleet | 222/95 X |
| 5,096,092 | 3/1992 | Devine | 222/95 |
| 5,143,390 | 9/1992 | Goldsmith | 222/386.5 X |

*Primary Examiner*—Andres Kashnikow
*Assistant Examiner*—Kenneth DeRosa
*Attorney, Agent, or Firm*—Henri J. A. Charmasson

[57] ABSTRACT

A collapsible liquid container is mounted within a pressure chamber, the chamber is pressurized either by an external air pump, or by a manual pump within the wall of the chamber. The pressure inside the chamber causes the wall of the container to collapse as liquid is drawn from it. A check valve mounted in a channel connecting the inside of the pressure chamber to the spout of the container transfers pressurized air into the container when the pressure within the container drops below the pressure in the chamber, in order to evacuate any liquid remaining into the container when the walls have been collapsed to the maximum extent possible.

15 Claims, 2 Drawing Sheets

PRESSURIZED CONTAINER DISPENSER

FIELD OF THE INVENTION

This invention relates to fluid dispensers, more specifically to pressurized or carbonated beverage containers and dispensing means.

BACKGROUND OF THE INVENTION

Carbonated beverages are commonly packaged in multiple serving containers of 1 liter or greater capacity. As servings are poured out of the container, the carbon dioxide in solution within the beverage, tends to escape into the space left between the liquid and the top of the container. Every time the container is unsealed to pour the next drink the carbon dioxide escapes into the air. After a few servings have been poured out of the container, the remainder of the beverage has lost most of its carbonation and turns flat A partial solution to this problem is provided by preventing the carbon dioxide which has gathered in the empty part of a partially drawn beverage container to escape. This can be achieved by replacing the cap of the container by a siphoning dispenser which uses the pressure created by the carbon dioxide in the top region of the container to push the liquid through a straw from the bottom of the container to a manually controllable valve in the dispensing cap. Such a device is disclosed in U.S. Pat. No. 4,860,932 Nagy. This type of carbonated drink dispensing device is effective so long as there is enough carbon dioxide to push the remaining liquid through the system. However, when the level of liquid drops within the bottle, some of the carbon dioxide escapes through the straw as the bottle is tipped. Moreover, as the liquid level drops, and the air gap expands, the carbon dioxide pressure is not enough to push the remainder of the liquid through the straw and out of the container.

SUMMARY OF THE INVENTION

The principal and secondary objects of this invention are are to provide a convenient means for preventing carbonated beverages which are packaged in multiple serving containers from losing their carbonation before the entire contents of the container has been poured out by preventing the carbon dioxide in suspension within the beverage to escape into voided areas of the container, and by increasing the pressure within the container itself to chase out the last remainder of the beverage.

These and other objects are achieved by enclosing a common plastic container used in connection with carbonated beverages in a pressurized chamber wherein the chamber pressure collapses the walls of the container as the beverage is drawn. Pressure from the chamber is also transferred into the container to flush out any remaining beverage after the walls have collapsed to their maximum extent.

DESCRIPTION OF THE PREFERRED EMBODIMENTS OF THE INVENTION

Figure 1:
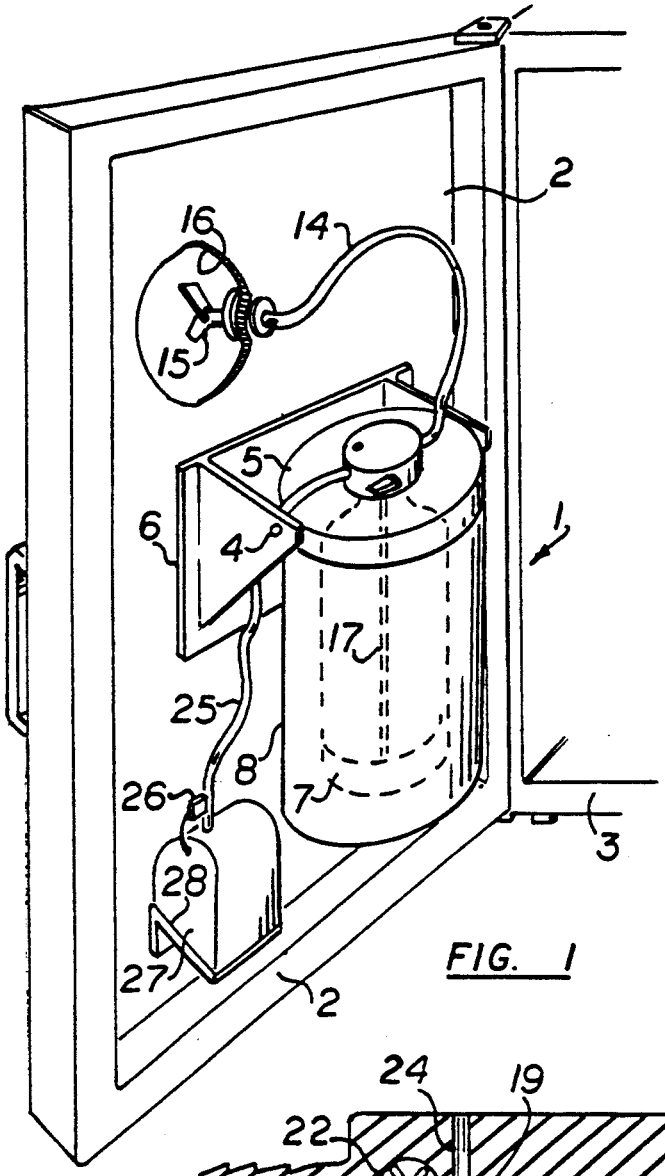
FIG. 1 is a perspective view of a pressurized liquid container dispenser installed within a refrigerated cabinet.

Referring now to the drawing, there is shown in FIG. 1 a pressurized liquid dispenser 1 installed within the door 2 of a refrigerated cabinet 3. The dispenser is suspended by a pair of pins 4 projecting in diametrically opposite directions from its lid assembly 5 to a bracket 6 secured to the back of the refrigerated cabinet door 2. The dispenser 1 is therefore free to swing or swivel around the axis of the pins 4 for convenient loading and unloading of the beverage container 7 shown in phantom line in FIG. 1. The dispenser can be loaded and unloaded by separating its main body 8 from the lid assembly 5 into which it is screwed. The beverage container 7 is preferably a plastic bottle with relatively soft and collapsible wall which is normally sealed by a screw top. This type of bottle is commonly used for packaging colas, sodas and other carbonated drinks and cocktail mixers in the so-called "family size" package.

Figure 2:
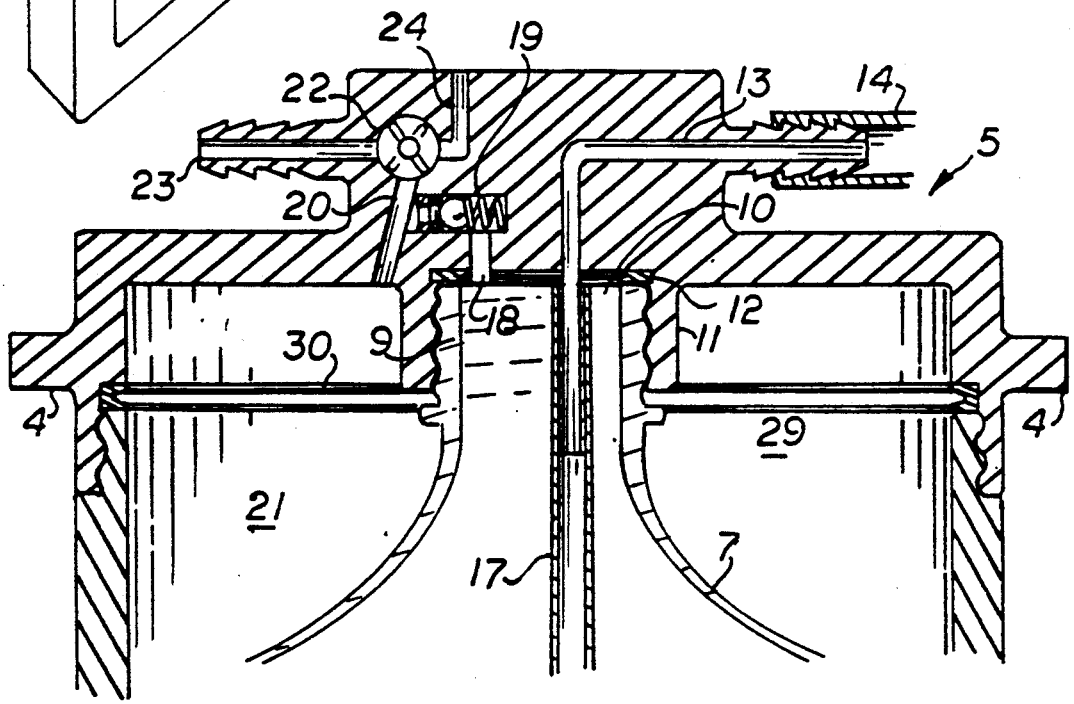
FIG. 2 is a partial cross-section of the pressure chamber and dispensing mechanism.

As more specifically illustrated in FIG. 2, the spout 9 of the container 7 is screwed into a coupling 11 in the inner surface of the lid assembly until the spout orifice 10 is seated against a rubber seal 12. A conduit 13 in the lid assembly allows the bottle spout coupling 11 to be connected via a flexible hose 14 to a tapper valve 15 mounted against the front face 16 of the refrigerated cabinet door 2. A cannula 17 connects the lid assembly conduit 13 to a bottom region of the container 7 opposite the spout. A separate channel 18 in the spout coupling 11 connects the container orifice 10 to a poppet check valve 19 in communication with another channel 20 leading first to the inside 21 of the dispenser and to a three-way valve 22. The three-way valve connects the second channel 20 either to an inlet port 23, or to an exit port 24 for decompressing the inside 21 of the dispenser. The inlet port 23 is connected via a flexible hose 25 to an air compressor 27 mounted on a bracket 28 against the back of the cabinet door. The compressor is electrically driven and its operation is controlled by a pressure sensitive switch 26. The switch responds to the pressure in the hose 25 and is preset to activate the compressor if the hose pressure drops below 0.35 atmosphere approximately, and to turn off the compressor when the hose pressure reaches 0.55 atmosphere approximately.

The screw connection at the pressure chamber aperture 29 between the lid assembly 5 and the main body 8 of the container is sealed by a V-ring 30.

When the valve 22 is set as shown in FIG. 2 to connect the inlet port 23 to the second channel 20 the inside 21 of the dispenser accumulates pressurized air which will squeeze and collapse the walls of the container 7 a liquid is forced out of it through the cannula 17, the lid assembly 13, the hose 14 and the tapper valve 15. As more liquid is forced out of the container, and its walls have collapsed to the maximum extent possible, any space between the remaining liquid and the spout 9 of the container will remain filled with $CO_2$ which has escaped from the liquid. If the pressure in that air space falls below 0.15 atmosphere (2 PSI) approximately the poppet check valve 19 opens allowing compressed air to pass from the pressure chamber into the container 7 thus facilitating flushing out the remainder of the liquid through the tapper valve 15.

Figure 3:
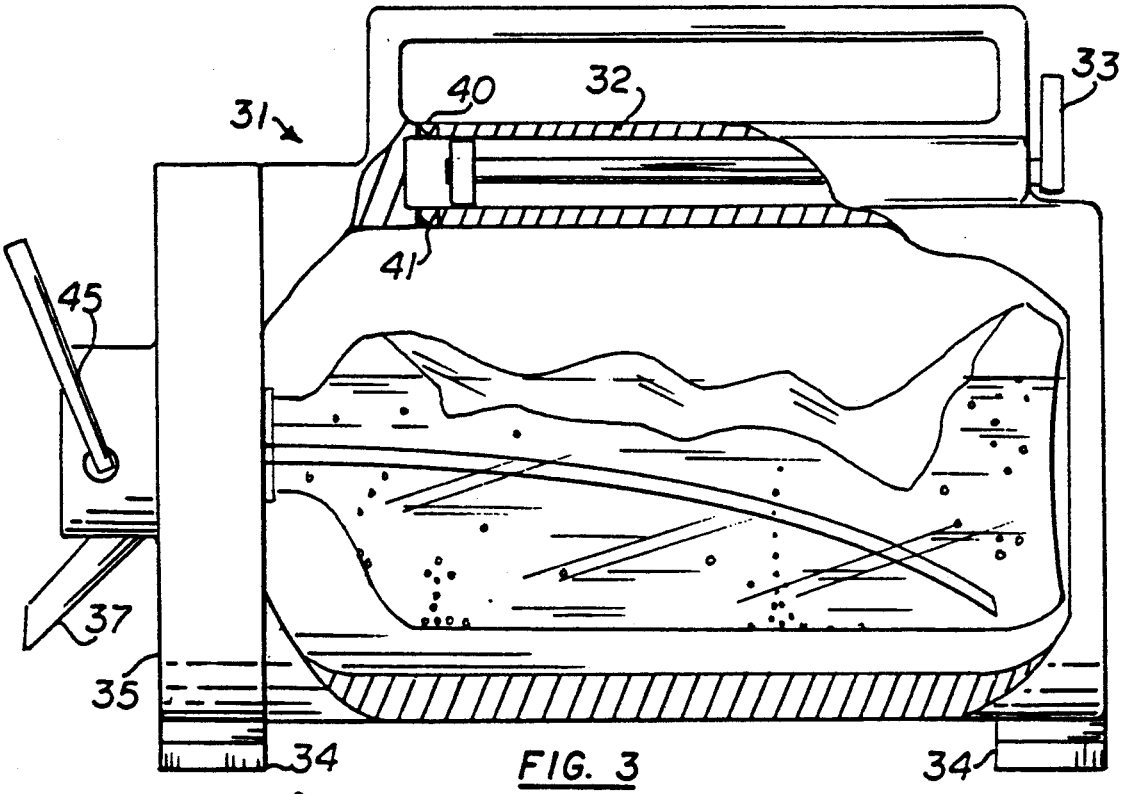
FIG. 3 is a side elevational view of a portable pressurized liquid dispenser with cut-outs exposing the internal mechanism.
Figure 4:
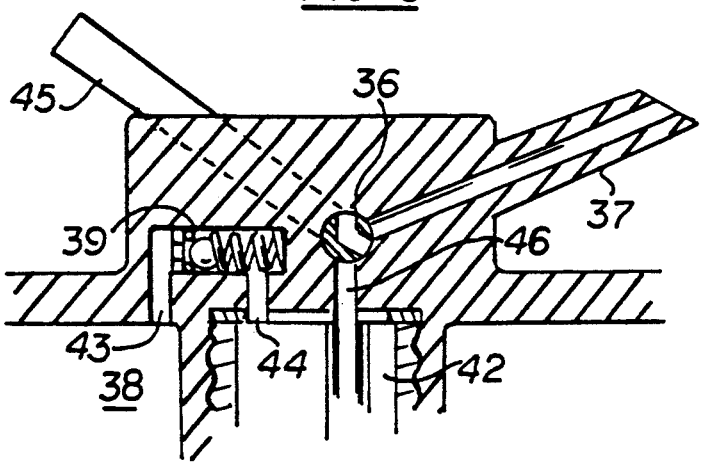
FIG. 4 is a cross-sectional view of the dispensing mechanism.

A second embodiment of the invention is illustrated in FIGS. 3 and 4 that comprises a portable pressurized liquid dispenser 31 which operates upon the same principle as the first embodiment 1, except that it is a free-standing unit which can be conveniently carried anywhere, and uses a manually operable pump 32 formed integrally within the walls of the dispenser. The dispenser features a convenient carrying handle 33 and a set of feet 34 which allows the dispenser to be held in a horizontal position in addition to an upright position. The lid assembly 35 of the second embodiment does not have an air inlet or three-way valve, but has a tapper valve 36 for controlling the lid assembly conduit 46 leading to a dispensing spout 37. The admission of outside air into the hand pump 32 and the injection of compressed air into the inside pressure chamber 38 are controlled by a set of conventional poppet valves 40 and 41. A check valve 39 similar to the check valve 19 of the first embodiment of the invention transfers compressed air from the inside 38 of the pressure chamber into the container spout 42 through channels 43 and 44 when the pressure difference between the inside of the container and the pressure chamber exceeds the preset pressure level required to activate the check valve. The valve 36 is activated by a convenient lever 45.

In each embodiment, the aperture of the pressure chamber that is closed by the lid assembly must be large enough to allow introduction of the beverage container, unless an alternate sealable opening is provided at the bottom or in the wall of the chamber.

The application invention is not limited to beverage dispensers but could apply to any carbonated or non-carbonated fluid dispenser such as dangerous chemicals that require careful handling.

While the preferred embodiments of the invention have been described, modifications can be made and other embodiments may be devised without departing from the spirit of the invention and the scope of the appended claims.

What is claimed is:

1. A liquid dispenser which comprises:

a pressure chamber having an aperture;

means for sealing the aperture;

a liquid container inside the chamber, said container having collapsible walls and a spout terminating into an orifice;

a channel having an opening into the chamber and an exit port connected to said orifice;

a check-valve in the channel, said check-valve being biased to allow fluid flow from said opening towards said exit port when a selected differential pressure between the chamber and the container is exceeded;

a sealable conduit passing through said aperture and orifice and having an inlet in a region of the container opposite the spout, and an outlet outside the chamber; and means for maintaining a certain pressure inside the chamber.

2. The dispenser of claim 1, wherein:

the aperture is shaped and dimensioned to accommodate passage of the container in an uncollapsed condition through said aperture;

said means for sealing comprise a lid assembly shaped and dimensioned to close the aperture, and having a coupling shaped and dimensioned to intimately and releasably engage the spout of the container;

said coupling having a first bore connected to said exit port and a second bore traversed by said conduit.

3. The dispenser of claim 2, which further comprises means for releasably closing said conduit.

4. The dispenser of claim 3, wherein said means for releasably closing comprises a tapper valve located outside said chamber.

5. The dispenser of claim 3, wherein said means for releasably closing comprise a tapper valve located with said lid assembly.

6. The dispenser of claim 2, wherein said means for maintaining a certain pressure comprise means for compressing air; and means for connecting said means for compressing to the chamber.

7. The dispenser of claim 6, wherein:

said means for compressing air comprise:

an electrically driven air compressor; and a pressure switch for activating the compressor, said switch being responsive to a pressure level in said means for connecting.

8. The dispenser of claim 6, wherein said means for compressing comprise a manually operable air pump.

9. The dispenser of claim 8, wherein said air pump is built integrally with said chamber.

10. The dispenser of claim 7, wherein said means for connecting comprise:

a three-way valve mounted on the lid assembly, said valve having a first port switchable to second and third ports, the first port being connected to the exit port of the channel; and a duct connecting the compressor to the second port.

11. A liquid dispenser which comprises:

a pressure chamber having an aperture;

means for sealing the aperture;

a liquid container inside the chamber, said container having collapsible walls and a spout terminating into an orifice;

a channel having an opening into the chamber and an exit port connected to said orifice;

a check-valve in the channel, said check-valve being biased to allow fluid flow from said opening towards said exit port;

a sealable conduit passing through said aperture and orifice and having an inlet in a region of the container opposite the spout, and an outlet outside the chamber;

means for maintaining a certain pressure inside the chamber;

the aperture being shaped and dimensioned to receive the container;

said means for sealing comprise a lid assembly shaped and dimensioned to close the aperture, and having a coupling shaped and dimensioned to intimately and releasably engage the spout of the container;

said coupling having a first bore connected to said exit port and a second bore traversed by said conduit;

said means for maintaining a certain pressure comprise means for compressing air; and means for connecting said means for compressing to the chamber;

said means for compressing air comprise:

an electrically driven air compressor; and a pressure switch for activating the compressor, said switch being responsive to a pressure level in said means for connecting;

said means for connecting comprise:

a three-way valve mounted on the lid assembly, said valve having a first port switchable to second and third ports, the first port being connected to the exit port of the channel; and a duct connecting the compressor to the second port;

in combination with a refrigerated cabinet wherein:

said cabinet comprises means for swivelingly suspending said chamber from said lid assembly against an inside structure of the cabinet;

the dispenser further comprises means for releasably closing said conduit.

12. The dispenser of claim 11, wherein said means for releasably closing comprise a tapper valve located outside said cabinet.

13. The dispenser of claim 11, wherein said means for releasably closing comprise a tapper valve located within said lid assembly.

14. The dispenser of claim 12, wherein said conduit passes through a bore in said cabinet; and said tapper valve is mounted against an outer structure of the cabinet.

15. The dispenser of claim 1 wherein said liquid container further comprises:

an oriented plastic bottle having a main body that includes a generally cylindrical side wall, a neck terminating in a neck finish on the upper end of the neck for receiving a closure, and a hemispherical bottom wall in which the radius of the hemisphere forming the bottom wall is substantially equal to the radius of the main body.

* * * * *